United States Patent [19]

Fitzpatrick et al.

[11] 4,291,504

[45] Sep. 29, 1981

[54] METHOD AND APPARATUS FOR IN-PROCESS GAGING OF TOOL ELEMENTS

[75] Inventors: Paul Fitzpatrick, Fenton; Richard J. Gavasso, West Olive, both of Mich.

[73] Assignee: Ex-Cell-O Corporation, Troy, Mich.

[21] Appl. No.: 126,922

[22] Filed: Mar. 3, 1980

[51] Int. Cl.[3] ..... B24B 49/06; B24B 1/00

[52] U.S. Cl. ..... 51/165.88; 51/165.91; 51/165.93; 51/290

[58] Field of Search ..... 51/165 R, 165.88, 165.91, 51/165.93, 290; 408/7, 12, 15; 409/132, 143, 171, 195

[56] References Cited

U.S. PATENT DOCUMENTS

| | | | |
|---|---|---|---|
| 2,741,071 | 4/1956 | Calvert | 51/165.93 X |
| 2,787,865 | 4/1957 | Gross | 51/165.93 X |
| 2,787,866 | 4/1957 | Gross | 51/165.93 X |
| 2,797,531 | 7/1957 | Seborg | 51/165.93 X |
| 2,845,752 | 8/1958 | Calvert | 51/165 R X |
| 2,870,577 | 1/1959 | Seborg | 51/165 R X |
| 3,286,409 | 11/1966 | Greenberg | 51/165.93 |

*Primary Examiner*—Gary L. Smith

*Attorney, Agent, or Firm*—Frank D. Risko

[57] ABSTRACT

A method and apparatus for gaging the cross-sectional bore diameter generated by an abrading type finishing tool in an abrading machine. The tool and plug gage are mechanically mounted to the same spindle with the plug sized to a predetermined diameter and mounted behind the machining element. The plug gage is indexed to enter the bore being machined at predetermined cycles to determine if an undersize condition of the tool exists. Failure of the plug gage to enter the bore would indicate an undersize condition of the tool and upon the gage entering the bore it would indicate a correct tool size. The invention has further apparatus for shutting down the machine in the event an undersize condition is determined.

12 Claims, 6 Drawing Figures

METHOD AND APPARATUS FOR IN-PROCESS GAGING OF TOOL ELEMENTS

BACKGROUND AND PRIOR ART

In the honing field or more generally the abrading field of sizing internal diameters, an inprocess plug gaging device is sometimes used to check the size of a bore based on a go-no-go gaging procedure. Such gaging devices are shown in the prior art to patents to Calvert, U.S. Pat. Nos. 2,741,071; Gross, 2,787,865 and 2,787,866; Seaborg, 2,870,577; Greenberg, 3,286,409. All of these patents show the operation of a honing machine wherein the plug gage will attempt to enter the bore during each reciprocating cycle of the honing apparatus, i.e., the hone will be rotated and reciprocated the length of the bore. As long as the honing operation is in progress and the plug cannot enter, the abrading machining process will continue. As soon as the plug is capable of entering the bore being honed, the machine will detect the entrance of the plug into the bore which signals that the bore has been machined to size, and the machine will then retract the abrading tool from the bore and shut down. All of the gaging elements in these patents use a biasing member to urge the plug gage into the bore which is being machined. All use some type of switch member to detect when the plug has entered the bore, and all gage the hole size on each reciprocation of the honing tool.

Also in the prior art are gages which use a tapered gaging surface so that the gage will enter the bore a little amount each time the honing stroke reciprocates. This tapered gage will eventually gage the bore to the proper diameter, be sensed by a switch of some type and discontinue the honing operating. The major difference is that a straight gage has a chamfer at its leading edge and once the gage can enter, it usually will go in all the way and terminating the honing operation.

Some honing machines manufactured by the assignee of the invention have used the type of in-process gaging just described. In addition, some gaging processes have used a timed sequenced operation for holding the plug gage out of the bore for a finite period of time and then allow the gage to enter the bore near the end of the time cycle. In most cases the time of honing is approximately known and a timing mechanism is used to hold the gage out for 80% of the cycle and allow it to try to enter for approximately 20% of the cycle. This has the obvious advantage of extending the life of the gage member.

Our invention operates with a new style of abrading tools, sometimes known as microsizing tools and shown in a patent to co-inventor Fitzpatrick, U.S. Pat. No. 4,173,852. These tools are constructed from a continuous cylinder having abrasive particles secured onto the sleeve member to provide the cutting section for the process. The sleeve member is usually spirally grooved or slotted so that the diameter of the member is adjustable by an inner tapered surface of the tool body sliding on a tapered arbor on the tool shaft. These tools are generally used in an application where it is only necessary to pass and retract the tool through the bore in a single cycle. That is, the tool would enter the bore on the first pass, go completely through and then on the retracting pass, go through the bore a second time and that would complete the machining operation. In these types of machining processes, a gaging plug is mounted directly behind the abrading tool, and the bore diameter can be checked each time the tool is cycled through a workpiece. That is, the gage can enter or at least attempt to enter, the hole or bore that is being machined; and if it does enter, the tool size is within tolerance. Because of the nature of this type of operation, excessive wear will occur since the plug gage is used on every cycle in the same manner as that described in the prior art patents.

One of the objects of our invention is to retain the plug gage out of contact with the workpiece bore until a predetermined number of parts have been machined; then allow the plug gage to attempt to enter the bore on the next cycle of the machine. If the plug gage cannot enter the bore then the machine will be stopped, and the diameter of the tool can be adjusted and the operation continued.

Another object of this invention is to have the plug gage member retained out of contact with the workpiece bore and drop by gravity feed to check the bore on selective parts.

It is also an object of this invention to have a switch means detect the entrance of the plug a predetermined distance into the workpiece.

It is further the object of this invention to have a biasing means associated with the plug gage means and a spacer between the abrading tool element and the plug gage to retain the gage displaced from the tool element. Such a spacer would maintain the plug gage out of the bore until such time as the stroke of the spindle is increased whereby the plug gage can then attempt to enter the bore.

It is further the object of this invention to have a switch means sense a plug gage with biasing means to to continue or terminate the function of the machine.

In summary, the invention is an apparatus and method for gaging the cross-sectional diameter of a bore during an in-process operation of an abrading machine having gage means operatively supported on the abrading tool. The gage size is fixed to a predetermined diameter and held out of contact with the workpiece. This gaging means would attempt to enter the bore being machined at selected intervals or cycles at a predetermined part sampling rate and failure of the plug gage to enter the bore would indicate that the tool has been worn to the low tolerance or to an undersize condition. The invention further has a switch means for sensing proper size of the bore to continue operation of the machine if the plug has entered the workpiece a predetermined distance. In other words, if the plug gage enters the bore, the tool is properly sized. If the gage does not enter the bore, the tool is now undersize and should be readjusted. This method is called by the inventors tool sizing by unplug gaging.

The objects, features and advantages of the present invention are readily apparent from the following description of the best mode for carrying out the invention taken in connection with the accompanying drawings.

DESCRIPTION

Figure 1:
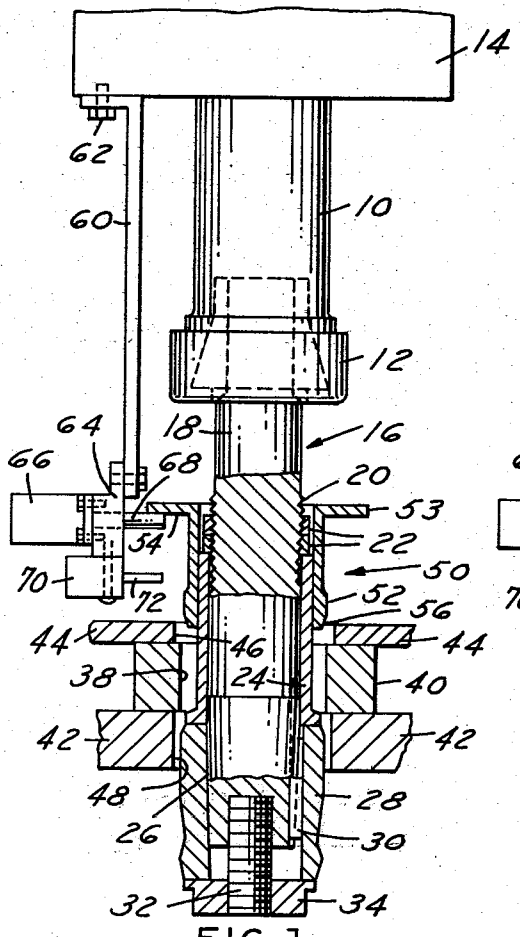
FIG. 1 is a sectional view showing the abrading tool passing through the workpiece and the gaging member retained in a non-contact position.

As shown in FIG. 1, the spindle 10 is affixed to the machine frame 14 by any convenient means well known in the art and such structure does not embody a part of the invention. Collet nut 12 holds the abrading tool assembly 16 into engaging contact with the machine spindle 10. The abrading tool assembly 16 comprises a shaft 18 having threads 20 at one section and a tapering diameter 26 at the end opposite the spindle nut 12. Sleeve 24 is slideably mounted on shaft 18 and abuts lock nuts 22 at one end and is in end to end contact with abrading element 28 at the other end. The abrading element 28 is held to the tapered diameter 26 by a key 30 which prevents rotation of abrading element 28. Stud 32 is threaded in shaft 18 having adjusting nut 34 in contact with abrading element 28. The abrading element 28 has a helical slot 36 which transverses the surface so that the element 28 can be slideably adjusted to change abrading diameter 29 on tapered arbor diameter 26 by tightening nut 34. The locking nuts 22 allow for the initial and subsequent axial adjustment of the abrading element 28 in conjunction with nut 34 to provide proper diametral size of the abrading tool.

Gage means 50 has a gaging diameter 52 and a chamfer 56 at one end and flange 53 at the other end. It is slideable on sleeve 24 and is retained in its non-operating or disengaged position by armature 68 which engages surface 54 of gage flange 53. The armature 68 is operated by solenoid 66. Bracket 60 is affixed to the machine housing 14 by bolt 62 at one end and has an adapter 64 fastened to bracket 60 at the other end by any convenient method. Solenoid 66 and switch means 70 are attached to adapter 64 by any convenient means. The solenoid 66 and armature 68 could be replaced by any other actuator device operating in a simple push-pull operation. A pneumatic or hydraulic actuator would serve equally as well.

The workpiece 40 is held on fixture table 42 by fixture workpiece clamp 44. In FIG. 1, the tool is shown in its lowest operating position having passed through bore 38 in workpiece 40. Clearance hole 48 in the fixture table 42 allows for passage of the tool and coolants. The workpiece clamp 44 also has a clearance hole 46 which allows the tool and gage member 50 to pass through. The armature 68 in its de-energized position engages the surface 54 to hold gage means 50 in an up or retained position until the gage cycling step.

Figure 3:
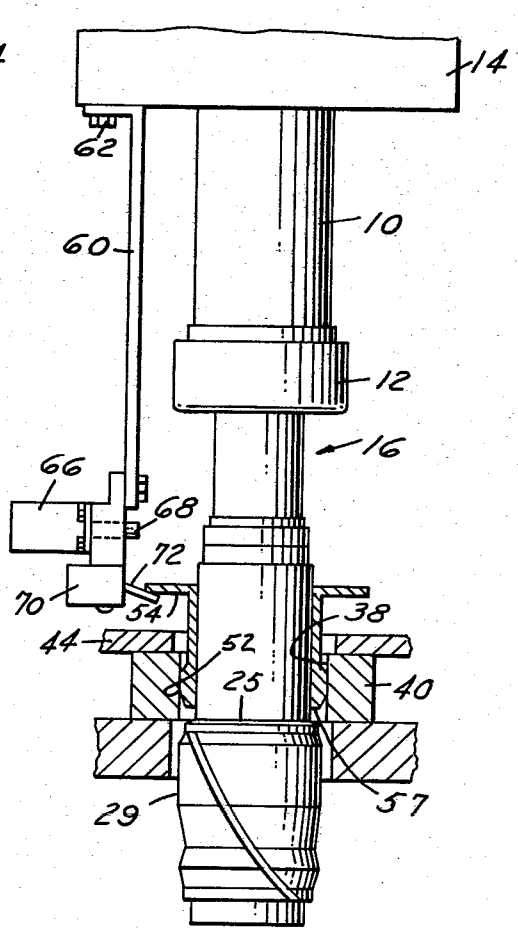
FIG. 3 is a cross-sectional view showing the gaging member released by the retainer means and entering the bore of the workpiece and engaging the switch means.

In operation as shown in FIG. 3, solenoid 66 is energized and armature 68 will retract allowing gage means 50 to drop. The abrading tool assembly 16 is shown in a downward most position with the gage means 50 inside bore 38 with gage diameter 52 engaging the bore 38 a predetermined distance and surface 54 contacting switch actuator 72 of switch means 70. Upon the upward movement of the abrading tool assembly 16, shoulder 25 will engage face 57 of gage means 50 and thereby retract the gage diameter 52 from bore 38. Upon removal of gage means 50 from the bore and full retraction of tool assembly 16, the actuated switch 70 will be reset and solenoid 66 will be de-energized causing armature 68 to now engage the surface 54 of gage means 50 and hold gage means 50 from contacting the workpiece. This switch signal would show the bore to be the correct size signifying a proper diameter abrading tool and operation of the machine can continue. The switch means 70 could be of the type having a set of normally open (NO) and normally closed (NC) contacts thereby giving a signal when actuated or when not actuated.

Figure 2:
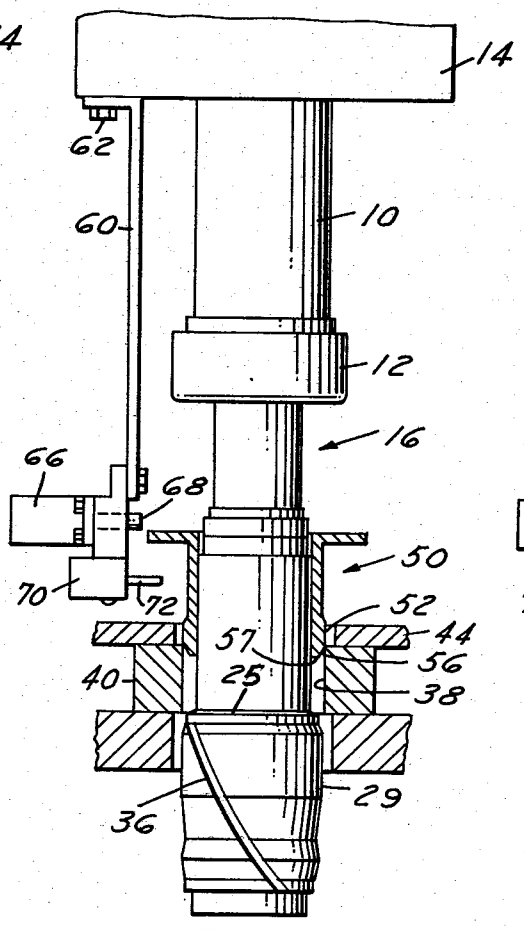
FIG. 2 is a cross-sectional view showing the gaging member released by the retainer means and attempting to enter the bore of the workpiece.

In subsequent operation, as shown in FIG. 2 the solenoid 66 is again energized causing gage means 50 to drop on the next down stroke or cycle of the machine spindle 10. As shown in FIG. 2, the gage surface 52 cannot enter bore 38 and does not allow surface 54 to contact switch actuator 72. The normally closed contact on switch 70 would give this signal. On the next stroke up of the machine, the shoulder 25 will engage the face 57 of gage means 50 thereby retracting the gage means from its engagement with bore 38 of workpiece 40. As the abrading tool assembly 16 is raised to its full disengaged or upmost position, the solenoid 66 will be de-energized and armature 68 will return to its extended position (as shown in FIG. 1) and on the next stroke of the machine surface 54 of gage means 50 will engage the armature 68 and hold the gage means 50 from contacting the workpiece bore 38. At this time the machine would be shut-down and stopped to adjust diameter 29 of the tool element 28. The machine could be programmed to machine a few more parts to determine if the lack of switch signal was due to error or that the tool has worn to an undersize condition.

It is obvious that the apparatus can be cycled so that in-process gaging could occur on each stroke of the machine so each part would be checked as in the prior art honing patents discussed earlier. This, of course, would defeat the purpose and intent of this invention. The invention contemplates that the machine will not have the gage means 50 entering the bore 38 on each part to be machined. After experience has been gained as to the relative amount of wear determined for a specific abrading tool in conjunction with the workpiece material, the cycle or index step would be set up so the gage means 50 would only be cycled to enter the bore after a certain number of pieces have been machined. As stated earlier, in this type of machining operation, the microsizing tool abrading element is passed into and out of the bore to be machined only once. If the gage means during that cycle cannot enter the bore, the bore is undersize and tool should be readjusted. This method of unplug gaging is believed by the inventors to be new and novel and not existing in the prior art.

Figure 4:
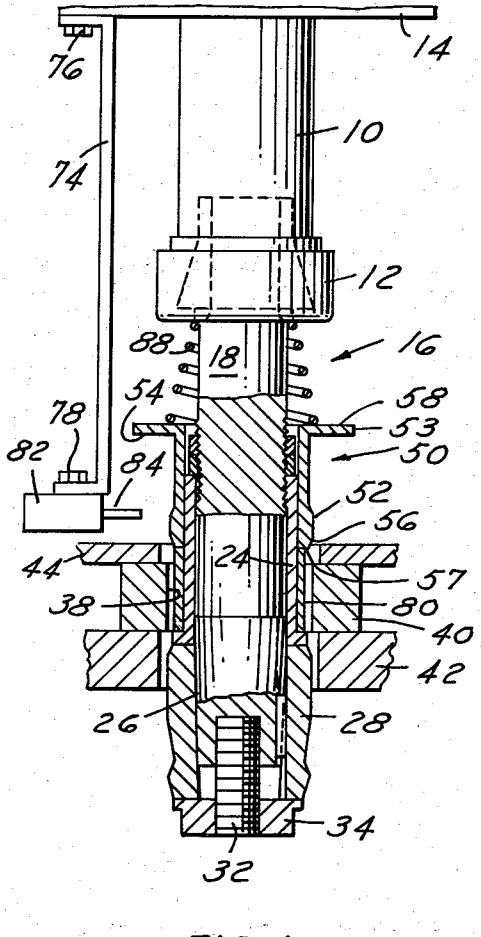
FIG. 4 is a cross-section view of an embodiment showing the abrading tool passing through the workpiece and with a biasing means holding the gaging member in nexus relationship with the abrading tool.

Another embodiment of the invention is shown in FIG. 4. Here a conical compression spring 88 is shown between surface 58 of flange 53 of gage means 50 and collet nut 12. The gage is held away from the abrading tool 28 by a spacer 80 which is fixedly held to the sleeve 24 and is in continuous contact with surface 25. The sleeve 24 could also be constructed with spacer 80 as an integral part of the sleeve member itself. The relationship between the abrading tool assembly 16 and the gage means 50 is established by the conical spring 88 which biases or pre-loads the gage means 50 toward the abrading element 28. Bracket 74 is affixed to housing 14 by bolt 76 at one end. To the other end of bracket 74 is mounted switch means 82 by screw 78 with switch actuator 84 part of switch means 82.

Figure 6:
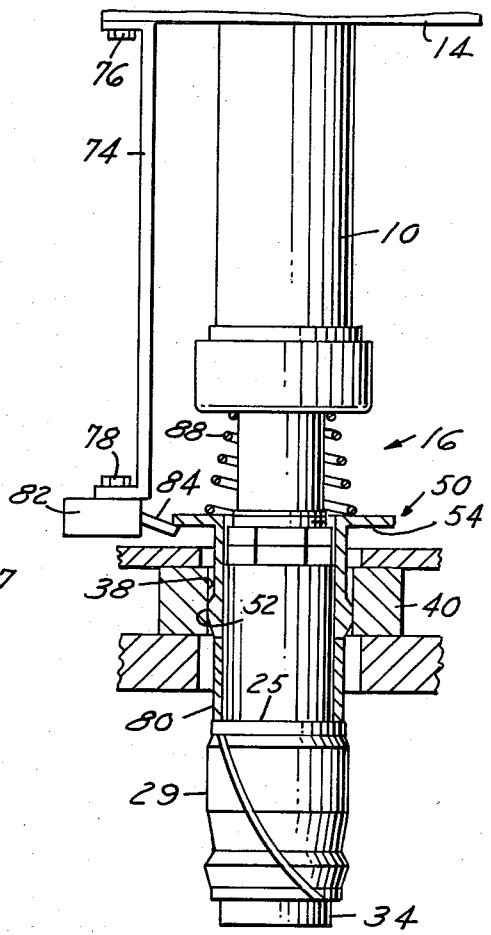
FIG. 6 shows a cross-sectional view of the gaging member entering the workpiece and engaging the switch means during an extended stroke cycle of the machine.
Figure 5:
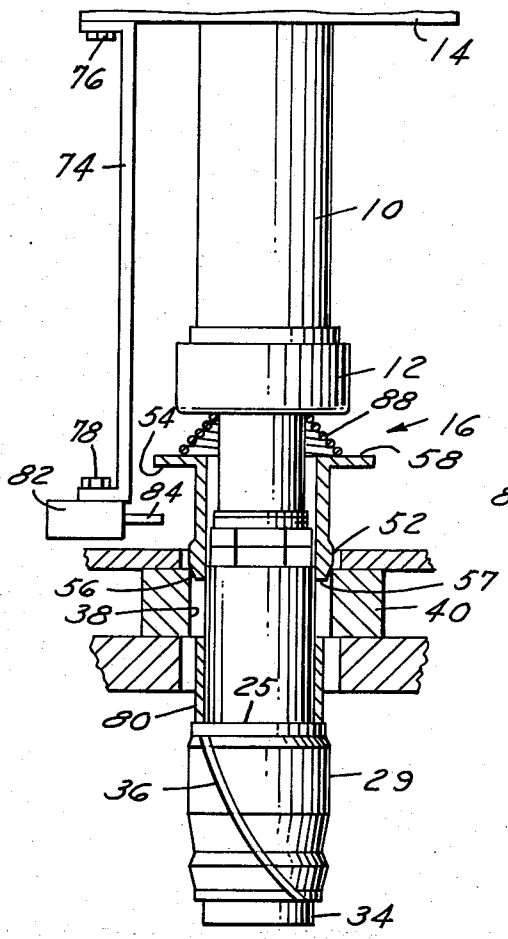
FIG. 5 shows a cross-sectional view of the gaging member attempting to enter the bore of the workpiece during an extended stroke cycle of the machine.

The operation of the machine spindle 10 in this embodiment is pre-set so at a given signal the spindle will stroke longer in the downward direction than on its normal machine cycle. In FIGS. 5 and 6 the tool 16 is shown being stroked farther than shown in FIG. 4. In FIG. 6, the gage diameter 52 of gage means 50 is shown engaging bore 38 of workpiece 40 a predetermined distance. The spring 88 at this time maintains surface 57 of gage means 50 in contact with spacer 80 and causes surface 54 of flange 53 to contact switch actuator 84 of switch means 82. This switch is similar to switch means 70 previously described. This switch signal would be used to indicate correct bore size and on the next upward stroke of the machine, the stroke would be altered to take the normal length strokes until the next gage cycle. This additional length stroke will only be taken at definite part intervals depending on the given type of abrading element and the workpiece material.

In FIG. 5 is again shown this additional length of stroke which now shows the chamfer 56 engaging the bore 38 and attempting to enter workpiece 40. In this case gage diameter 52 cannot enter bore 38 and the conical spring 88 will compress as shown. No contact will be made between surface 54 and switch actuator 84. Therefore on the up stroke, the spacer 80 will re-engage face 57 of gage means 50 and the machine stroke would be re-set to normal stroke length for the next part piece to be machined. This absence of a switch signal would indicate that the tool element 28 is undersize and the machine should be stopped to adjust the diameter 29 as described earlier.

Other modifications to the invention can be made without departing from the spirit and scope of its intent. For example, the solenoid in the first embodiment can be an electrical solenoid with an armature 68 or can be an hydraulically or pneumatically operated actuator which would serve the same purpose of retaining the gaging means 50 from engagement with the bore 38. The switch means 70 or 82 shown in the embodiments are shown as a microswitch or momentary contact spring type switch. This switch could be replaced by a simple inductive type proximity switch that would sense the position of the flange 53 or by a magnetically operated reed switch with a magnetic material for flange 53. These type switches would be used in the same manner as the microswitch signal previously described. That is, it would be used to shut the machine down on its return stroke when contact is not made.

It is also apparent that the gage means could use a tapered gaging surface as discussed earlier or that the gage means could be mounted below the tool element. Here the bore would be checked by having the machine stroke higher in the up direction for the gaging cycle. Such changes or embodiments are obviously well within the scope and intent of our invention.

Since this type of tool is applied to a workpiece in a single pass through and retract cycle, total stock removal capability of the tool is achieved in this single cycle. Stock removal capability per pass is comparatively low and is usually limited to a maximum of a few thousandths of an inch and is somewhat determined by the abrasive grit size, i.e. coarser grit abrasives having greater stock removal capability than finer grit abrasives.

When stock removal requirements in a workpiece exceed the capability of a single tool single pass operation, multiple tools and spindles are often used. These individual tool are adjusted to progressively larger diameter sizes to stay within the stock removal capability of each individual tool. These tools may be used in a machining center application whereby multiple tools may be exchanged within a individual spindle each with a progressively larger tool size. Therefore, the invention is equally adapted for use in any machine tool such as a turret lathe, multiple spindle boring machine or the like.

In either case, it is particularly advantageous to monitor workpiece bore diameter to insure that each tool is producing the proper diameter size to produce workpieces within required tolerances and also to protect downstream tools from exceeding their stock removal capabilities.

In summary then, our invention as described, is an unplug sizing means for checking the tool size of an abrading tool. If the gaging means does not enter the bore a predetermined distance during a stroke of the machine, a switch signal that the tool size has been worn to a dimension that is at the low limit of the tolerance for the bore will be detected by the machine control and the machine should be stopped and the tool adjusted to the appropriate dimension. If the gaging means enter the bore, the tool is properly sized. This in-process gaging need not be used each cycle of the machine because the part being machined only requires a single pass of the tool and the types of tools which this is used with has extremely low wear rates. Therefore, the gage would be held out of the bore and then indexed or sequenced once every 50 or 75 pieces depending upon the particular characteristics of the abrading tool and workpiece material. Obviously, it could be used on every stroke but that would defeat its purpose. The switch mechanism could be connected or used with a logic scheme in a machine control whereby once an undersize condition is detected the gage would try to enter on every piece thereafter. A predetermined number of undersize bores could then initiate a signal to indicate that an undersize tool condition has been reached. Obviously it could be stopped and checked on the first such signal. This signal could also provide a visual or audible signal that machine shut down has occurred. In high production automated systems it is not unusual to have an alarm of some type such as a horn or flashing light to signal when a tool goes out of tolerance and therefore this scheme would be very appropriate in that environment.

From the foregoing description, it will be seen that this specification and drawings have provided embodiments for a gaging means for the internal surface of a bore by employing an indexing scheme to reduce the wear on the plug gage and improve the overall reliability of the equipment. While preferred embodiments of the invention have been illustrated and described, it will be understood that various changes and modifications may be made without departing from the spirit of the invention.

I claim:

1. An apparatus for gaging the cross-sectional diameter of an adjustable abrading tool in an abrading machine to a pre-determined diameter by gaging the diameter of a workpiece bore being machined and controlling the operation thereof comprising (a) a gage means slideable mounted on said abrading tool shaft means, (b) means for selectively engaging said gage means at predetermined intervals into a workpiece bore, (c) means for disengaging said gage means from said bore, and (d) means for selectively stopping said abrading machine when said gage means fails to enter said bore.

2. The apparatus of claim 1 wherein said gage means has an annular shape and is mounted around said tool means and is held in a disengaged position by an actuator means and is disengaged from said workpiece bore by an ejector means.

3. The apparatus of claim 2 wherein said means for selectively stopping said abrading machine is a switch means.

4. The apparatus of claim 3 wherein said switch means is a microswitch.

5. The apparatus of claim 3 wherein said switch means is a proximity switch.

6. The methd for gaging the cross-sectional diameter of a shaft mounted abrading tool during the machining operation in an abrading machine to a predetermined diameter by gaging the diameter of the workpiece bore being machined and for controlling the machining cycles thereof comprising the steps of (a) holding a gage means mounted on the abrasive tool shaft in a disengaged position from a workpiece bore, (b) selectively indexing said gage means to enter said bore and re-positioning said gage means to its disengage position, (c) sensing by a sensing means if said gage means does not enter said workpiece bore a predetermined distance, and (d) controlling the machine cycles in response to the sensing means.

7. The method of claim 6 wherein said sensing means includes switch means used for controlling the machining operation.

8. The method of claim 6 wherein the selective indexing operation occurs after a predetermined number of parts have been machined.

9. An apparatus for gaging the cross-sectional diameter of an abrading tool in a machine tool to a predetermined diameter by gaging the diameter of the workpiece bore being machined and for controlling the cycle of operation thereof comprising (a) a spindle means, (b) an abrading tool assembly fixedly attached to said spindle means having a shaft means, (c) an abrading element adjustably held to said shaft means, (d) a gage means slideably mounted on a sleeve means adjustable held onto said shaft means, (e) a spacer means maintaining separation of said gage means and said abrading element, (f) means for biasing said gage means between said spacer means and said spindle, (g) means for selectively engaging said gage means into said workpiece bore, (h) means for disengaging said gage means from said bore, and (i) means for selectively stopping said machine.

10. The apparatus of claim 9 wherein said means for selectively stopping said abrading machine is a switch means.

11. The apparatus of claim 10 wherein said means for selectively stopping said abrading machine is a microswitch.

12. The apparatus of claim 10 wherein said switch means is a proximity switch.

* * * * *